US006103065A

United States Patent [19]

Humphreys et al.

[11] Patent Number: 6,103,065

[45] Date of Patent: Aug. 15, 2000

[54] METHOD FOR REDUCING THE POLYMER AND BENTONITE REQUIREMENT IN PAPERMAKING

[75] Inventors: Harry Nelson Humphreys, Fort Mill, S.C.; Charles Talmadge, Charlotte, N.C.

[73] Assignee: BASF Corporation, Mt. Olive, N.J.

[21] Appl. No.: 09/281,400

[22] Filed: Mar. 30, 1999

[51] Int. Cl.[7] ..... D21H 17/68; D21H 17/56

[52] U.S. Cl. ..... 162/181.8; 162/168.1; 162/168.3; 162/181.1; 162/158

[58] Field of Search ..... 162/181.1, 181.8, 162/168.1, 168.2, 168.3, 183, 158

[56] References Cited

U.S. PATENT DOCUMENTS

| | | | |
|---|---|---|---|
| 2,368,635 | 2/1945 | Booth | 92/21 |
| 4,305,781 | 12/1981 | Langley et al. | 162/164 |
| 4,749,444 | 6/1988 | Lorz et al. | 162/168.3 |
| 5,015,334 | 5/1991 | Derrick | 162/168.1 |
| 5,266,164 | 11/1993 | Novak et al. | 162/168.2 |
| 5,393,381 | 2/1995 | Hund et al. | 162/168.3 |
| 5,595,629 | 1/1997 | Begala | 162/158 |
| 5,676,796 | 10/1997 | Cutts | 162/158 |
| 5,858,174 | 1/1999 | Persson et al. | 162/164.1 |

FOREIGN PATENT DOCUMENTS

| | | |
|---|---|---|
| 93/13265 | 7/1993 | WIPO . |

*Primary Examiner*—Stanley S. Silverman
*Assistant Examiner*—José A. Fortuna

[57] ABSTRACT

The present invention relates to a method for reducing the polymer and bentonite requirement in papermaking wherein medium and high molecular weight polymers are reacted with bentonite. Further, mechanical shearing of the furnish after polymer addition is not required.

20 Claims, No Drawings

METHOD FOR REDUCING THE POLYMER AND BENTONITE REQUIREMENT IN PAPERMAKING

FIELD OF INVENTION

The present invention relates to a method for reducing the polymer and bentonite requirement in papermaking wherein medium and high molecular weight polymers are reacted with bentonite. Further, mechanical shearing of the furnish after polymer addition is not required.

BACKGROUND OF INVENTION

Economy and quality are concerns in the art of paper making. Those skilled in the art are always seeking to optimize these two features of the paper making process. The basic paper making process is known to those skilled in the art. For the sake of completeness, a general description of the paper maker's art is presented herein.

The material that paper is made from is called "furnish". Furnish is mostly fiberous material, to which is sometimes added mineral fillers, and chemical additives. The most common fiberous material is wood pulp. Grasses, cotton, and synthetics are used occasionally. Wood is made up of fibers (cells) which are held together with lignin.

Wood pulp is made by either chemically or mechanically separating the fibers. Different methods give variations in quality. Chemical wood pulp is typically of high quality. It as long smooth fibers, but is expensive to produce. Mechanical pulp is less expensive. The fibers are shorter, often with a very rough surface. Recycled pulp is made by slurrying waste paper in water. The fibers come out shorter and more degraded than they were originally. A variety of methods are used to bleach the fibers whiter, and remove contaminants. Some of these methods further degrade the fibers. Extremely short fibers are called "fines" and are less than 1/100 of an inch long. Fines can amount to over 50% of the total fiber.

The wood pulp or furnish is transferred to the paper machine as a slurry of about 4% fiber and 96% water and is called "thick stock". Mineral fillers may be added to this slurry. A typical addition is 10% filler, which is commonly either kaolin clay, or calcium carbonate (e.g., chalk). These fillers are very small particles, typically around 1 micron in size. Chemicals are then added to improve the properties of the paper, such as strength, water resistance or color.

At this point the furnish is ready to be added to the paper machine. In order to make paper, the furnish is further diluted down, to approximately 1.0% solids. This is referred to as "thin stock". The "thin stock" goes through screens and cleaners which impart a great deal of shear into the slurry. The "thin stock" then goes into the "headbox" which delivers the slurry onto a moving "forming" fabric or "wire".

After the furnish is put on the forming fabric or "wire", most of the water is removed by gravity and vacuum. The fines (much of the mechanical and recycled fiber) and all of the filler are small enough to go through the fabric or "wire". In order to keep these particles in the paper, they must be flocculated into larger particles.

While on the "wire" the solids content is raised up to around 15%. The paper is then run through presses that squeeze more water out to give solids of approximately 40–50%. The systems that use high molecular weight polymers give good dewatering on the wire, but often retard dewatering in the press section.

The final water removal stage uses steam dryers. A very small change in water removal in the press section makes a huge difference in the dryer section. The dryer section is the largest part of the machine, and typically limits the production rate.

Those skilled in the art of papermaking are always seeking ways to improve the paper manufacturing process. Specifically, U.S. Pat. No. 4,305,781, assigned to Allied Colloids Limited, discloses a method of making paper with improved drainage and retention properties of a cellulosic suspension. The method involves the addition of polymers having a molecular weight of above 500,000 to about 1,000,000 or above (column 3, lines 8–13) to the suspension. The polymers employed must be substantially non-ionic such as polyacrylamides (column 3, lines 14–16 and lines 27–33). The polymer is added the suspension after the last point of high shear prior to sheet formation (column 3, lines 66–68). The bentonite is added to the suspension in the thick stock, the hydropulper, or the re-circulating white-water (column 4, lines 3–8). The bentonite must be added prior to the polymer and at least one shear point will occur between the bentonite and polymer addition. The patent does not disclose the formation of small flocs.

U.S. Pat. No. 5,015,334, assigned to Laporte Industries Limited, discloses a colloidal composition and its use in the production of paper and paperboard (column 1, lines 9–11). The patent discloses that a polymer can be added to paperstock followed by adding bentonite to the paperstock without shearing between the addition of the polymer and the bentonite (column 2, lines 38–52 and column 4, lines 19–29). The polymer employed is a low molecular weight water-soluble, high charge density polymer having a molecular weight below 100,000 (column 3, lines 12–25).

Although the patent discloses that shearing is excluded between the addition of the polymer and bentonite in treating the paperstock, the patent does not disclose the formation of small flocs as the subject invention. Also, the patent employs low molecular weight polymers, not the medium molecular weight polymers, i.e., 100,000–2,000,000, as the process of the present invention.

U.S. Pat. No. 5,393,381, assigned to S N F, France, discloses a process for the manufacture of paper or cardboard having improved retention properties (column 1, lines 6–8). The process involves adding a branched, high molecular weight polymer such as a polyacrylamide (column 2, lines 43–56) to paper pulp followed by shearing the mixture (column 3, lines 28–34) then adding bentonite to the mixture (column 3, lines 34–37).

The high molecular weight branched polymers are employed because such polymers retain bentonite on a paper sheet better than non-branched polymers (column 2, lines 14–23).

The patent does not disclose employing the specific medium molecular weight branched polymers of the subject invention. Further, there is no discussion of the formation of small flocs. Additionally, the patent employs a shearing process between the addition of the polymer and the bentonite to the pulp unlike the present invention which eliminates the shearing process.

U.S. Pat. No. 5,676,796 assigned to Allied Colloids Limited, discloses a method for making paper or paperboard (column 1, lines 1–5). The method is directed to improving the retention, drainage, drying, and formation properties in paper making (column 3, lines 42–51). The process involves forming a thick cellulosic stock suspension and flocculating (column 3, lines 54–61 and column 4, lines 4–8) with a first polymer (column 6, lines 64–67 and column 7, lines 1–7). The first polymer employed can be a low anionic, a nonionic, and a low and medium cationic polymer (column 9, lines 63–67 and column 10, lines 1–6). The thick stock is then diluted to form a thin stock (column 3, lines 62–63). The large flocs are then formed into small dense flocs in the thin stock by adding a coagulant such as a non-ionic polymer having a molecular weight of below 1,000,000 or 500,000 (column 4, lines 8–14, column 7, lines 8–33, and column 11, lines 42–51). In addition to the first and second polymer, bentonite can be added either before, with, or after the addition of the flocculant polymer (column 6, lines 50–63).

Preferably, the bentonite is added after the addition of the second polymer to the thin stock (column 4, lines 20–24). Prior to adding the bentonite, the stock is sheared (column 6, lines 58–63 and column 12, lines 36–39).

Although U.S. Pat. No. 5,676,796 discloses the formation of small flocs, by adding a polymer having a molecular weight of below 1,000,000, the method of the present invention employs a medium molecular weight polymer to form small flocs without the formation of large flocs by high molecular weight polymers as disclosed in U.S. Pat. No. 5,676,796. The present invention employs some high molecular weight polymers only to maintain the stability of the small flocs. Further, the method disclosed in U.S. Pat. No. 5,676,796 always employs shearing prior to adding bentonite. In contrast, the present invention does not employ shearing between adding the polymer and bentonite to the papermaking furnish.

Applicants' invention improves on the art because their program uses less polymer than a conventional bentonite program, improves press section dewatering, which increases the solids going into the dryers, and reduces drying requirements. Further, one less shear step is required.

DEFINITIONS AND USAGES OF TERMS

The term "furnish," as used herein, means a mostly fiberous material, to which is sometimes added mineral fillers, and chemical additives. The most common fiberous material is wood pulp. Grasses, cotton, and synthetics are used occasionally.

The term "bentonite", as used herein, means an alkaline activated montmorillonite or similar clay such as hectorite, nontrite, saponite, sauconite, beidellite, allevardite, halloysite, and attapulgite. The bentonite clay must be swelled in water to expose maximum surface area. If the clay does not swell naturally, it must be activated, or converted to it's sodium, potassium, or ammonium form. This type of activation is obtained by treating the clay with a base such as sodium or potassium carbonate.

The term "copolymer," as used herein means a polymer produced from more than one type of monomer.

The term "homopolymers," as used herein means a polymer produced from a single type of monomer.

The term "floc," as used herein, means: an agglomeration of long fibers, fines and fillers.

The term "retention," as used herein, means that portion of the solid phase of the furnish that is retained on the forming fabric (i.e., wire).

The term "first pass ash retention," as used herein, means the amount of ash retained on the wire compared to the total amount of ash delivered to the wire.

The term "charge density," as used herein, means the amount of positive electrical charge relative to the mass of the polymer.

The term "Canadian Standard Freeness (CSF)," as used herein, means a measure of the rate at which pulp will allow water to freely drain out; it is an indication of the relative amounts of long and short fibers in the furnish.

SUMMARY OF THE INVENTION

The present invention relates to a method for improving the retention and drainage of papermaking furnish comprising the steps of:

a. adding 0.005% to 0.25% by weight of at least one cationic high charge density polymer of molecular weight 100,000–2,000,000 having a charge density in excess of 4.0 Meq. to said furnish, after all points of high shear, to form small flocs having a size range of less than ¼ inch in diameter;

b. Adding 0% to 0.20% by weight of at least one polymer having a molecular weight greater than 2,000,000 and a charge density of less than 4.0 Meq;

c. adding 0.025–2.0% by weight water swellable bentonite clay.

The present invention further relates to a method for improving the retention and drainage of papermaking furnish comprising the steps of:

a. adding 0.005% to 0.25% by weight of at least one cationic high charge density polymer of molecular weight 100,000–2,000,000 having a charge density in excess of 4.0 Meq selected from the group consisting of crosslinked polyethyleneimine homopolymers or copolymers or polymers produced from ethyleneimine, amidoamine, acrylamide, epichlorhydrate, diallyldimethylamonium halides, allylamines, etheramines, vinylamines, vinyl-heterocycles, N-vinylimidazole and methylacrylates, to said furnish, after all points of high shear, said high shear occurring prior to said polymer addition, to form small flocs having a size range of less than ¼ inch in diameter;

b. adding 0% to 0.20% by weight of at least one polymer having a molecular weight greater than 2,000,000 having a charge density of less than 4.0 Meq selected from the group consisting of, polyacrylamides produced by copolymerizing acrylamide and/or methacrylamide with anionic monomers such as acrylic acid, methacrylic acid, maleic acid, vinyl sulphonic acid, or cationic monomers such as $C_1$- or $C_2$-alkylamino-$C_2$–$C_4$alkyl (meth)acrylates, diethylamino-Ethyl acrylate, diethylaminoethylmethacrylate, dimethylaminopropyl acrylate, dimethylaminobutyl acrylate, dimethylaminopentyl acrylate and the corresponding methacrylates;

c. adding 0.025–2.0% by weight of a hydrated slurry of a swellable bentonite clay.

All dosages are based on dry polymer or pigment as a weight percent (weight %) of dry furnish unless otherwise indicated.

DETAILED DESCRIPTION OF THE INVENTION

The present invention relates to a method for improving the retention and drainage of papermaking furnish comprising the steps of:

a. adding 0.005% to 0.25% by weight of at least one cationic high charge density polymer of molecular weight 100,000–2,000,000 having a charge density in excess of 4.0 Meq. to said furnish, after all points of high shear, to form small flocs having a size range of less than ¼ inch in diameter;

b. Adding 0% to 0.20% by weight of at least one polymer having a molecular weight greater than 2,000,000 and a charge density of less than 4.0 Meq;

c. adding 0.025–2.0% by weight water swellable bentonite clay.

The present invention further relates to a method for improving the retention and drainage of papermaking furnish comprising the steps of:

a. adding 0.005% to 0.25% by weight of at least one cationic high charge density polymer of molecular weight 100,000–2,000,000 having a charge density in excess of 4.0 Meq selected from the group consisting of crosslinked polyethyleneimine homopolymers or copolymers or polymers produced from ethyleneimine, amidoamine, acrylamide, epichlorhydrate, diallyldimethylamonium halides, allylamines, etheramines, vinylamines, vinyl-heterocycles, N-vinylimidazole and methylacrylates, to said furnish, after all points of high shear, said high shear occurring prior to said polymer addition, to form small flocs having a size range of less than ¼ inch in diameter;

b. adding 0% to 0.20% by weight of at least one polymer having a molecular weight greater than 2,000,000 having a charge density of less than 4.0 Meq selected from the group consisting of, polyacrylamides produced by copolymerizing acrylamide and/or methacrylamide with anionic monomers such as acrylic acid, methacrylic acid, maleic acid, vinyl sulphonic acid, or cationic monomers such as $C_1$- or $C_2$-alkylamino-$C_2$–$C_4$alkl (meth)acrylates, diethylamino-Ethyl acrylate, diethylaminoethylmethacrylate, dimethylaminopropyl acrylate, dimethylaminobutyl acrylate, dimethylaminopentyl acrylate and the corresponding methacrylates;

c. adding 0.025–2.0% by weight of a hydrated slurry of a swellable bentonite clay.

All dosages are based on dry polymer or pigment as a weight % of dry furnish unless otherwise indicated.

THE PRACTICE OF THE PRESENT INVENTION

STEP a:

Any cationic polymer with a charge density greater than 4.0 Meq, and molar mass in excess of 100,000 can be used as the medium molecular weight polymer in Step 1 of the present invention.

Selection of the proper medium molecular weight cationic polymer, is critical. There are two performance factors to consider. A substantial difference in retention and drainage has been observed between polymers. In addition, some polymer types control the level of additional flocculation of the high molecular weight polymer far better than others. Improved total performance typically occurs with increasing charge density, molecular weight and significant branching or crosslinking in the polymer chain. Preferred polymers include those with charge densities of 6.0 Meq or higher, and molecular weight in excess of 250,000. More preferred are those polymers containing ethyleneimine, or amidoamine with molecular weight in excess of 500,000. The most preferred polymers are modified polyethyleneimine polymers which are graft copolymers of polyethyleneimine and amidoamine crosslinked to form a highly branched structure, such as POLYMIN® SKA available from BASF, Mt. Olive, N.J. The POLYMIN® products have a molecular weight of about 1,200,000 and a charge density in the range of 8 to 14 Meq at a 4.5 pH.

The cationic medium molecular weight polymer is used at levels of 0.005 to 0.25 weight %. The preferred use level is 0.01 to 0.2 weight %, the more preferred use level is 0.015 to 0.15 weight %. The most preferred use level is 0.02 to 0.10 weight %.

When the forming section of the paper machine has only low to moderate shear, the high charge density cationic polymer of Step a followed by bentonite will normally be sufficient. Under higher shear conditions, the microflocs formed by the high charge density cationic polymer may not have sufficient stability. A second polymer must now be added. This is Step b. of the present invention.

STEP b:

The polymer(s) used in Step b. can be any polymer with a molecular weight in excess of 2 million, and which is reactive to the furnish. It will typically be used at dosages below 0.1 weight %. Preferred level is 0.001 to 0.1 weight %. Most preferred level is 0.01 to 0.06 weight %. Preferred products are polyacrylamides with a molecular weight of 4 million or greater. More preferred are cationic acrylamides, and most preferred are cationic acrylamides with a charge density of less than 4.0 Meq, preferably between 0.8 and 2.5 Meq. An example of a suitable high molecular weight polymer is Polymin® KE78 (cationic polyacrylamide) from BASF AG, Ludwigshafen, Germany.

Typically, Step a. precedes Step b. However, it is often possible to premix the Step a. and b. polymers and use a single addition point. The two polymers must of course be compatible for this type application. Use of this simultaneous addition technique is especially well suited when a combination of modified polyethyleneimine, and cationic polyacrylamide is used. In this case, not only is polymer addition simplified, but a slight improvement in polymer efficiency is often observed.

STEP c:

After the microflocs are formed, bentonite clay is added to the furnish. The normal application rate is 0.025 to 2.0 weight %, based on furnish solids. Preferred application rates are 0.05 to 1.5 weight %, more preferred 0.1 to 1.0 weight %, and most preferred 0.2 to 0.5 weight %. The bentonite clay may be any silicate that has charged sites capable of reacting with polymer. Preferred clay is an alkaline activated montmorillonite or similar clay such as hectorite, nontrite, saponite, sauconite, beidellite, allevardite, halloysite, and attapulgite. More preferred are the montmorillonite clays, and most preferred are those that exhibit substantial viscosity when slurried in water at 5 to 10 percent solids, and allowed to age. An example of this type product is Opazil® NH from BASF Corp.

The bentonite clay must be swelled in water (hydrated) to expose maximum surface area. This occurs after the pigment is slurried in water and allowed to age. The aging process typically takes 30 to 150 minutes. If the clay does not swell naturally, it must be activated, or converted to it's sodium, potassium, or ammonium form. This type of activation is obtained by treating the clay with a base such as sodium or potassium carbonate. Application of shear to the slurry can reduce the time required for some clays to swell.

The application point for the bentonite is after the polymer has been mixed with the urnish. This will typically be just before the headbox or vat. Optimum results are obtained when there are no shear points between or after the polymer and bentonite applications.

OPTIONAL INGREDIENTS

Some papermaking systems have high levels of contaminants in the water circuit. These contaminants are typically anionic materials in either a colloidal state, or in solution. Some examples include wood resins, deposit control agents, pulping, bleaching or deinking chemicals, waste paper contaminants, and humic acid. In the case of heavily contaminated systems, it may be preferable to pretreat the furnish with at least one anionic scavenger.

The anionic scavenger can be any cationic substance. Preferred substances have a high cationic charge, such as aluminum containing compounds including, but not limited to, aluminum sulfate, polyaluminum chloride and/or high charge density (Meq>6.0), cationic polymers such as polyethyleneimine, polydadmac, polyvinylamine, or any other high charge density cationic polymer. More preferred are those polymers with a charge density of 8.0 Meq or higher. Most preferred are polyethyleneimine cationic polymers with a charge density above 10.0 Meq, and a molecular weight of about 750,000. An example of this type product is Polymin® PL from BASF Corp.

In some cases it may be possible to use the same polymer for charge neutralization as is used in Step a. This is done for the sake of simplifying the number of products needed. If on the other hand, maximum polymer efficiency is sought, the anionic scavenger will typically be higher in cationic charge, and lower in molecular weight than the Step a. polymer.

In addition, standard papermaking additives typically can be used in combination with this invention. This includes products that improve wet or dry strength, sizing or absorbency, reduce foam, bacterial growth or deposits as well as pigments or coloring agents. If any of the additives are highly anionic, it is normally preferable to add them with at least one shear point between the additive, and the cationic polymers.

THE FOLLOWING NON-LIMITING EXAMPLES ILLUSTRATE THE PRESENT INVENTION

Basic Lab Protocol:

A mixture of 50 percent bleached kraft softwood with a Canadian Standard Freeness (CSF) of 700, 40 percent thermomechanical pulp with a CSF of 10, and 10 percent recycled coated paper is diluted to 0.6 weight percent solids with white water. Alum is added to achieve a 4.8 pH. The furnish (1000 ml) is treated with polymer, then the microparticle bentonite or colloidal silica (if any) is added. The suspension is placed in a Modified Schopper Reigler drainage tester (MSR), and the time required for 300 cc of filtrate to drain is logged. The solids in the filtrate is then determined by filtering the 300 cc of filtrate through a No. 4 Watmanno filter paper under vacuum.

EXAMPLE 1

Example 1 lab series was run with each polymer added at 0.025 weight % and activated bentonite added at 0.25% based on dry product on paper stock. No shear was added in this first series the tests. The effect on fines and filler retention is shown below.

| | Unretained Solids (mg)/300 mg of filtrate | |
|---|---|---|
| Polymer Type | Polymer only | After Bentonite |
| No polymer | 1270 | 1190 |
| Modified Polyethyleneimine | 940 | 420 |
| Polyamidoamine | 1050 | 550 |
| Polyethyleneimine | 1070 | 510 |
| PolyDADMAC | 1230 | 670 |
| Polyetheramine | 1140 | 710 |

As can be seen, the addition of bentonite clay after a high charge density polymer resulted in improved retention. The polymers were listed in descending molecular weight. The first three products were substantially branched while the last two products were predominantly linear. The benefits of higher molecular weight and a branched configuration are apparent.

EXAMPLE 2

The following chemicals were used in these comparisons:

Polymer A; Modified polyethyleneimine (Polymin® SKA from BASF Corp.) Polymer A is produced by grafting polyethyleneimine onto polyamidoamine, and then crosslinking to form a product with a molecular weight of slightly over 1,000,000 and a cationic charge density of 9 Meq/gram. reported as dry product.

Polymer B, a high molecular weight cationic polyacrylamide emulsion with a molecular weight of approximately 5,000,000 and a charge density of 1.8 Meq/gram (Polymin® PR8578 from BASF Corp.)

Microparticle C, activated bentonite clay (Opazil® NH by BASF Corp) formed by slurrying a sodium carbonate activated montmorillonite clay and water, and gently agitating until the viscosity peaks. Reported as dry product.

Microparticle D, colloidal silica dispersion, as received (BMA® 780 from Akzo Nobel)

Polymer E, a nonionic polyacrylamide. (Polymin® NP4 from BASF Corp.)

Polymer F is polyethyleneimine with a molecular weight of 700,000 and a charge density of 20 Meq. (Polymin® PR971L from BASF Corp.)

Unless stated otherwise, the order of addition is polymer first, shear (if applied) followed by the microparticle.

| Test# | Polymer | Shear | Microparticle | Drainage time | Unretained Solids-mg/ 300 mg of filtrate |
|---|---|---|---|---|---|
| 1 | blank | no | none | 178 | 1190 |
| 2 | 0.02% A | no | none | 149 | 1010 |
| 3 | 0.02% B | no | none | 147 | 750 |
| 4 | 0.01% A | | | | |
| | 0.01% B | no | 0.25% C | 45 | 305 |
| 5 | 0.02% B | yes | 0.25% C | 143 | 920 |
| 6 | 0.04% B | yes | 0.25% C | 112 | 710 |
| 7 | 0.06% B | yes | 0.25% C | 53 | 265 |
| 8 | 0.02% B | yes | 0.25% D | 74 | 470 |
| 9 | 0.03% B | yes | 0.50% D | 42 | 320 |
| 10 | 0.01% A | | | | |
| | 0.01% B | yes | 0.25% C | 48 | 460 |
| 11 | 0.01% A | | | | |
| | 0.01% B | no | 0.50% C added first | 47 | 600 |
| 12 | 0.02% E | no | 0.50% C added first | 64 | 640 |

In these tests, Test 12 is the organosorb system as disclosed in U.S. Pat. No. 2,368,635, incorporated by reference herein, and Test 11 is described in U.S. Pat. No. 4,749,444, incorporated by reference herein. Both of these tests, as well as Tests 2 and 3 (polymer only) gave insufficient retention. Test 9 is the optimized Composil® collodial silica system, while Test 7 is the Hydrocol®, bentonite system as described in U.S. Pat. No. 5,676,796, incorporated by reference herein. Note that the present invention (Test 4) gives equivalent performance with significantly lower chemical applications. The floc size for Tests 4 and 7 were similar, while Test 9 had slightly larger floc size. Test 10 indicates that the addition of shear to the invention reduces system performance.

EXAMPLE 3

The benefits of utilizing an anionic scavenger was investigated. These tests used the same furnish as in Example 2, with the exception that Test #4 and #5 deleted the treatment with alum. The polymers used were also the same as those used in Example 2, Polymer A is modified polyethyleneimine, Polymer B is cationic polyacrylamide, and Polymer F is polyethyleneimine with a molecular weight of 700,000 and a charge density of 20 Meq. (Polymin® PR971 L from BASF Corp.)

| Test# | Polymer | Shear | Microparticle | Drainage time | Unretained Solids-mg |
|---|---|---|---|---|---|
| 1 | 0.01% A<br>0.01% B | no | 0.25% C | 45 | 305 |
| 2 | 0.01% F<br>0.01% A<br>0.01% B | no | 0.25% C | 35 | 220 |
| 3 | 0.02% A<br>0.01% B | no | 0.25% C | 39 | 235 |
| 4 | 0.01% A<br>0.01% B | no | 0.25% C | 54 | 360 |
| 5 | 0.01% F<br>0.01% A<br>0.01% B | no | 0.25% C | 37 | 250 |

Test #4 is the invention with no prior treatment of the furnish to reduce detrimental anionic substances. Test #5 utilized an anionic scavenger (Polymer F) in addition to the invention. In test #1, 2, and 3, alum was added prior to the polymers at approximately 0.5% based on dry furnish. Tests #2 used an anionic scavenger (Polymer F) in addition to the alum. Test #3 utilized additional medium molecular weight polymer from the invention (Polymer A) in place of the anionic scavenger in test #2.

Use of an anionic scavenger improved retention and drainage in all 4 cases. Note that the lowest retention, and slowest drainage where obtained on test #4 which used no anionic scavenger. Comparing Test #2 and #3 reveals that using Polymer F to pretreat the furnish gave superior results to using additional Polymer A. Comparing Test #1 with Test #5 indicates that polymer as a neutralizer gives superior performance over alum. However, the greatest effect was observed in Tests #2 and #3 using both polymer and alum.

EXAMPLE 4 (Plant Trial)

Further evidence of the superiority of the invention, is exhibited in the following paper machine plant trial data. The twin wire machine was running lightweight coated paper at 3600 feet per minute using 44% thermomechanical pulp, and 56% bleached softwood kraft. The furnish had been treated with alum and polyethyleneimine prior to the paper machine to neutralize and fixate detrimental substances. The polymers (A, B and C) utilized are the same as those in the prior examples. The polymers were applied after the last point of high shear, to the discharge of the headbox screens, and the bentonite clay was added 15 feet farther downstream. The first pass ash retention is calculated by the difference in ash concentration between the headbox and tray water, divided by the headbox concentration.

| | Standard Program | Trial (Applicant's Invention) |
|---|---|---|
| Retention Aids | 0.025% A<br>0.02% B | 0.025% A<br>0.02% B<br>0.30% C |

-continued

| | Standard Program | Trial (Applicant's Invention) |
|---|---|---|
| Tray Solids | 0.62% | 0.53% |
| Headbox Drainage Time | 134 sec | 109 sec |
| First Pass Ash Retention | 28% | 36% |
| Formation Index | 91 | 91 |

As can be seen, the invention improved retention and drainage without an increase in polymer flow. Sheet formation was unaffected, proving that the proper chemical selection can modify the floc structure without the need for shear.

We claim:

1. A method for improving the retention and drainage of papermaking furnish comprising the steps of:

a. adding 0.005% to 0.25% by weight of at least one cationic high charge density polymer of molecular weight 100,000–2,000,000 having a charge density in excess of 4.0 Meq. to said furnish, after the last point of high shear, such that small flocs having a size range of less than ¼ inch in diameter are formed;

b. either concurrently with or subsequent to step a., adding 0% to 0.20% by weight of at least one polymer having a molecular weight greater than 2,000,000 and a charge density of less than 4.0 Meq;

c. subsequent to steps a. and b., adding 0.025–2.0% by weight of a hydrated slurry of a swellable bentonite clay.

2. The method of claim 1 wherein said of at least one cationic high charge density polymer of molecular weight 100,000–2,000,000 having a charge density in excess of 4.0 Meq. to said furnish, after all points of high shear, to form small flocs having a size range of less than ¼ inch in diameter;

b. adding 0% to 0.20% by weight of at least one polymer having a molecular weight greater than 2,000,000 and a charge density of less than 4.0 Meq is polyacrylamide produced by copolymerizing acrylamide and/or methacrylamide with monomers selected from the group consisting of:
acrylic acid,
methacrylic acid,
maleic acid,
vinyl sulphonic acid,
$C_1$- or $C_2$-alkylamino-$C_2$–$C_4$alkyl (meth)acrylates,
Diethylaminoethylacrylate,
diethylaminoethylmethacrylate,
dimethylaminopropyl acrylate,
dimethylaminobutyl acrylate,
dimethylaminopentyl acrylate,
dimethylaminopropyl methacrylate,
dimethylaminobutyl methacrylate, and
dimethylaminopentyl methacrylate.

3. The method of claim 2 wherein said at least one cationic high charge density polymer is a crosslinked polymer or copolymer produced from at least on type of monomer selected from the group consisting of:

ethyleneimine, amidoamine, acrylamide, epichlorhydrate, diallydimethylammonium halides, allylamines, etheramines, vinylamines, vinyl-heterocycles, N-vinylimidazole and methylacrylates.

4. The method of claim 2 wherein the polymer of step (b) has a molecular weight of at least 4,000,000.

5. The method of claim 4 wherein the polymer of step (b) is a cationic polyacrylamide having a charge density of between 0.8 and 2.5 Meq, inclusive.

6. The method of claim 1 wherein said at least one cationic high charge density polymer is selected from the group consisting of:

crosslinked polyethyleneimine homopolymers or copolymers and; polymers produced from ethyleneimine, amidoamine, acrylamide, epichlorhydrate, diallyldimethylamonium halides, allylamines, etheramines, vinylamines, vinyl-heterocycles, N-vinylimidazole and methylacrylates.

7. A method, according to claim 6, wherein the cationic high charge density polymer of Step a. is a graft copolymer of polyethyleneimine and amidoamine; wherein further, the polymer used in Step b. is a cationic polyacrylamide having a charge density of 0.8 to 2.5 Meq.

8. The method of claim 1 wherein the cationic high charge density polymer has a molecular weight of 250,000 or more.

9. The method of claim 8 wherein the cationic high charge density polymer has a molecular weight of 500,000 or more.

10. The method of claim 9 wherein the cationic high charge density polymer has a molecular weight of 1,200,000 or more.

11. The method of claim 10 wherein the cationic high charge density polymer has a charge density of 8–14 Meq at 4.5 pH.

12. The method of claim 11 wherein the cationic high charge density polymer is a modified polyethyleneimine polymer.

13. The method of claim 12 wherein the cationic high charge density polymer is a crosslinked graft copolymer of polyethyleneimine and amidoamine.

14. The method of claim 13 wherein the cationic high charge density polymer is added at 0.02 to 0.1 weight %.

15. The method of claim 8 wherein the cationic high charge density polymer has a charge density in excess of 6 Meq.

16. The method of claim 1 wherein the cationic high charge density polymer is added at 0.01 to 0.2 weight %.

17. The method of claim 16 wherein the cationic high charge density polymer is added at 0.02 to 0.1 weight %.

18. The method of claim 1 wherein the polymer of step (b) has a molecular weight of at least 4,000,000.

19. The method of claim 1 wherein the polymer of step (b) is added at less than 0.1% by weight.

20. A method for improving the retention and drainage of papermaking furnish comprising the steps of:

a. adding one or more anionic scavenger substances selected from the group consisting of cationic polymers and aluminum containing compounds;

b. adding 0.005% to 0.25% by weight of at least one cationic high charge density polymer of molecular weight 100,000–2,000,000 having a charge density in excess of 4.0 Meq. to said furnish, after the last point of high shear, such that small flocs having a size range of less than ¼ inch in diameter are formed;

c. adding 0% to 0.20% by weight of at least one polyacrylamide polymer having a weight greater than 2,000,000 and a charge density of less than 4.0 Meq and produced by copolymerizing acrylamide and/or methacrylamide with monomers selected from the group consisting of:

acrylic acid,
methacrylic acid,
maleic acid,
vinyl sulphonic acid,
$C_1$- or $C_2$-alkylamino-$C_2$–$C_4$alkyl (meth)acrylates,
Diethylaminoethyl acrylate,
diethylaminoethylmethacrylate,
dimethylaminopropyl acrylate,
dimethyl aminobutyl acrylate,
dimethylaminopentyl acrylate
dimethylaminopropyl methacrylate,
dimethylaminobutyl methacrylate, and dimethylaminopentyl methacrylate; and d. adding 0.25–2.0% by weight of a hydrated slurry of a swellable bentonite clay.

* * * * *